US011524856B2

(12) United States Patent
Kanamitsu

(10) Patent No.: US 11,524,856 B2
(45) Date of Patent: Dec. 13, 2022

(54) MEDIUM FEEDING DEVICE

(71) Applicant: SEIKO EPSON CORPORATION, Tokyo (JP)

(72) Inventor: Masatomo Kanamitsu, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 232 days.

(21) Appl. No.: 16/424,603

(22) Filed: May 29, 2019

(65) Prior Publication Data

US 2019/0367307 A1 Dec. 5, 2019

(30) Foreign Application Priority Data

May 31, 2018 (JP) ..... JP2018-105055

(51) Int. Cl.
*B65H 7/12* (2006.01)
*B65H 3/06* (2006.01)

(52) U.S. Cl.
CPC ..... *B65H 7/12* (2013.01); *B65H 3/06* (2013.01)

(58) Field of Classification Search
CPC ..... B65H 3/06; B65H 3/0669; B65H 3/0684; B65H 1/266; B65H 7/12
See application file for complete search history.

(56) References Cited

U.S. PATENT DOCUMENTS 4,365,795 A * 12/1982 Fukushima ..... B65H 9/00 271/146
8,585,050 B2 * 11/2013 Syracuse ..... B65H 7/125 271/258.01
8,882,107 B2 11/2014 Tojo et al.
10,059,543 B2 8/2018 Kanamitsu
2007/0126171 A1 6/2007 Takeuchi et al.
2014/0103599 A1 4/2014 Tojo et al.
2014/0291915 A1 * 10/2014 Inoue ..... B65H 3/0607 271/109
2017/0107068 A1 * 4/2017 Kanamitsu ..... B65H 1/14

FOREIGN PATENT DOCUMENTS

CN 103723534 A 4/2014
CN 206142493 U 5/2017
JP 2004-284709 * 10/2004
JP 2006-165857 A 6/2006
JP 2007-153560 A 6/2007
JP 2012-162335 A 8/2012
JP 2015-131703 A 7/2015

OTHER PUBLICATIONS

Machine translation of JP2015-131703. (Year: 2015).*

* cited by examiner

*Primary Examiner* — Thomas A Morrison
(74) *Attorney, Agent, or Firm* — Global IP Counselors, LLP

(57) ABSTRACT

A medium feeding device is provided with a feeding section for feeding a medium and sensors for detecting the medium. The feeding section includes a feed roller and a separation roller, the sensors form a sensor line in which the plurality of sensors is aligned in a feeding direction of the medium to be fed, the two sensor lines are arranged in such a manner that the sensors overlap with each other in a width direction of the medium to be fed, and the sensor lines are so configured as to extend, in the feeding direction, from an upstream region upstream of a nip point where the feed roller and the separation roller make contact with each other, a nip region including the nip point, and to a downstream region downstream of the nip point.

13 Claims, 6 Drawing Sheets

MEDIUM FEEDING DEVICE

The present application is based on, and claims priority from JP Application Serial Number 2018-105055, filed May 31, 2018, the disclosure of which is hereby incorporated by reference herein in its entirety.

BACKGROUND

1. Technical Field

The present disclosure relates to a medium feeding device configured to feed a medium.

2. Related Art

In JP-A-2006-165857, as an example of a medium feeding device, there is disclosed an image input device provided with detection sensors for detecting a medium to be fed. In this image input device, a skew of the medium is detected by a plurality of detection sensors arranged in series in a width direction of the medium to be fed.

In this kind of image input device, there is room for improvement in detection precision when a skew of a medium to be fed is detected.

SUMMARY

A medium feeding device configured to solve the above issue is provided with a feeding section for feeding a medium and sensors for detecting the medium. The feeding section includes a feed roller and a separation roller, the sensors form a sensor line in which the plurality of sensors is aligned in a feeding direction of the medium to be fed, at least two of the sensor lines are arranged in a width direction of the medium to be fed, and the sensor lines are so configured as to extend, in the feeding direction, from an upstream region upstream of a nip point where the feed roller and the separation roller make contact with each other, a nip region including the nip point, and to a downstream region downstream of the nip point.

DESCRIPTION OF EXEMPLARY EMBODIMENTS

Hereinafter, an embodiment of a medium feeding device will be described with reference to the drawings. The medium feeding device is, for example, a sheet feed scanner configured to read out images such as a character and a picture recorded on a medium such as paper to be fed.

Figure 1:
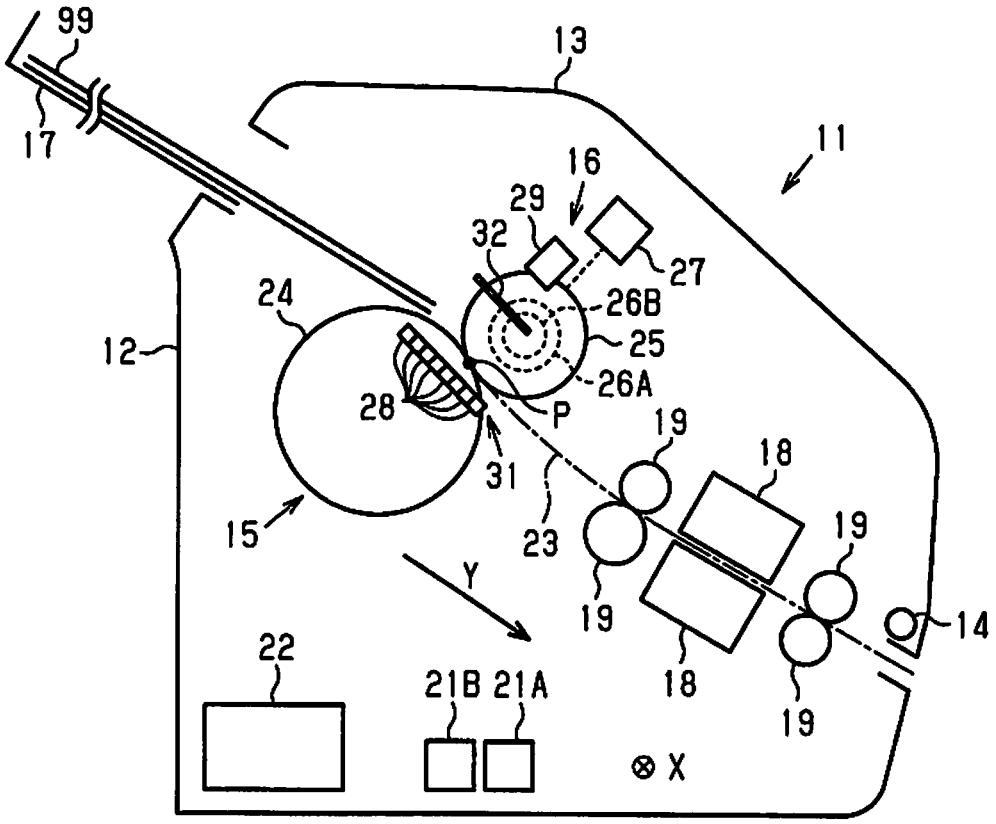
FIG. 1 is a side view schematically illustrating an embodiment of a medium feeding device.

As illustrated in FIG. 1, a medium feeding device 11 includes a housing 12, and a cover 13 that opens and closes with respect to the housing 12. The cover 13 rotates about a shaft 14, for example, so as to open and close with respect to the housing 12. The cover 13 is closed in FIG. 1. The interior of the housing 12 is exposed when the cover 13 is opened.

The medium feeding device 11 includes a feeding section 15 for feeding a medium 99, and a sensor 16 for detecting the medium 99. The medium feeding device 11 includes a tray 17 in which the medium 99 to be fed is stacked, a reader unit 18 for reading the medium 99, and a transport roller 19 for transporting the medium 99. The medium feeding device 11 includes a first motor 21A, a second motor 21B, and a control unit 22 configured to control the overall device.

The medium feeding device 11 includes a transport path 23 on which the medium 99 is transported. The transport path 23 of the present embodiment extends in a space between the housing 12 and the cover 13, as indicated by a dot-dash line in FIG. 1. The feeding section 15, the sensor 16, the reader unit 18, and the transport roller 19 are located to be along the transport path 23. The medium 99 fed by the feeding section 15 is transported on the transport path 23 so as to be read by the reader unit 18. Accordingly, on the transport path 23, a direction from the feeding section 15 toward the reader unit 18 is a transport direction Y of the medium 99. In the present embodiment, the feeding direction of the medium 99 fed by the feeding section 15 is identical with the transport direction Y.

The feeding section 15 feeds the medium 99 stacked in the tray 17 toward the transport path 23. The feeding section 15 includes a feed roller 24 and a separation roller 25. The feeding section 15 feeds the medium 99 by the feed roller 24 and the separation roller 25 rotating in a state of nipping the medium 99 therebetween. The feed roller 24 is rotated by the drive of the first motor 21A. The separation roller 25 is rotated by the drive of the second motor 213. The feed roller 24 and the separation roller 25 may be configured to be rotated by a shared motor. The feed roller 24 and the separation roller 25 are so located as to form a nip point P at which these rollers make contact with each other. Because of this, the feed roller 24 and the separation roller 25 nip the medium 99 therebetween at the nip point P.

The feed roller 24 of the present embodiment is attached to the housing 12. The feed roller 24 is so configured as to rotate in a clockwise direction in FIG. 1, by the drive of the first motor 21A. The feed roller 24 rotates while making contact with the medium 99 located at the lowest position among the media 99 stacked in the tray 17, thereby feeding the medium 99 in contact with the feed roller 24 toward the nip point P. The feed roller 24 rotates in such a manner as to feed the medium 99 downstream in the transport direction Y.

When the feed roller 24 guides the medium 99 to the nip point P, a plurality of media 99 may be guided to the nip point P due to friction force generated between the media 99. In this case, the plurality of media 99 is nipped in a superposed state between the feed roller 24 and the separation roller 25. In other words, the plurality of media 99 may be fed in a superposed state. Feeding the media 99 in a state of the plurality of media 99 being superposed in this manner, is also referred to as multi-feeding. When the media 99 are multi-fed, there is a risk that an image recorded in the medium 99 cannot be read out accurately by the reader unit 18. In order to suppress the above-mentioned multi-feeding of the media 99, the separation roller 25 is so configured as to separate the plurality of superposed media 99 one by one. In this kind of medium feeding device, there is room for improving the precision in detection of the multi-feeding of media to be fed.

The separation roller 25 of the present embodiment is attached to the cover 13. The separation roller 25 is so configured as to rotate in a clockwise direction in FIG. 1, by the drive of the second motor 21B. The separation roller 25 rotates in such a manner as to return the medium 99 upstream in the transport direction Y. In the present embodiment, a rotational direction causing the medium 99 to be transported downstream in the transport direction Y is defined as a forward rotation direction, while a rotational direction causing the medium 99 to be transported upstream in the transport direction Y is defined as a reverse rotation direction. In this case, the feed roller 24 is so configured as to rotate in the forward rotation direction by the drive of the first motor 21A. The separation roller 25 is so configured as to rotate in the reverse rotation direction by the drive of the second motor 21B.

A torque limiter 26A and a clutch 26B are attached to the separation roller 25. The torque limiter 26A and the clutch 26B are a mechanism to connect the second motor 21B and the separation roller 25 in such a manner as to transmit driving power of the second motor 21B to the separation roller 25. The torque limiter 26A is so configured as to shut off the connection between the separation roller 25 and the second motor 21B when a rotational load equal to or larger than a predetermined value is applied to the separation roller 25. In other words, when the rotational load equal to or larger than the predetermined value is applied to the separation roller 25, the connection between the separation roller 25 and the second motor 21B by the torque limiter 26A is shut off. With this, the drive of the separation roller 25 by the second motor 21B is stopped. The clutch 26B is so configured as to shut off the connection between the separation roller 25 and the second motor 21B controlled by the control unit 22.

When the feed roller 24 and the separation roller 25 nip one sheet of media 99 therebetween, toque of the feed roller 24 rotating in the forward rotation direction is transmitted to the separation roller 25 rotating in the reverse rotation direction via the above one sheet of media 99. In other words, the torque of the feed roller 24 serves as a rotational load on the separation roller 25. When the feed roller 24 and the separation roller 25 nip one sheet of media 99 therebetween, the toque of the feed roller 24 is likely to be transmitted to the separation roller 25. Thus, in this case, the torque limiter 26A shuts off the connection between the separation roller 25 and the second motor 21B. When the connection between the separation roller 25 and the second motor 21B is shut off, the separation roller 25 rotates in such a manner as to be driven by the rotation of the feed roller 24. In this case, the separation roller 25, like the feed roller 24, rotates in the forward rotation direction.

When the feed roller 24 and the separation roller 25 nip multiple sheets of media 99 therebetween, the medium 99 making contact with the feed roller 24 differs from the medium 99 making contact with the separation roller 25. Friction force of the medium 99 acting on another medium 99 is smaller than friction force of the medium 99 acting on the feed roller 24 as well as friction force of the medium 99 acting on the separation roller 25. In other words, since the medium 99 making contact with the separation roller 25 and the medium 99 making contact with the feed roller 24 slide on each other, the torque of the feed roller 24 rotating in the forward rotation direction is unlikely to be transmitted to the separation roller 25. Because of this, in this case, the medium 99 making contact with the feed roller 24 is fed downstream in the transport direction Y. The medium 99 making contact with the separation roller 25 is returned upstream in the transport direction Y. In this manner, the separation roller 25 causes the multiple media 99 to be separated one by one. As a result, the separation roller 25 suppresses the multi-feeding of the media 99.

The separation roller 25 may be configured in such a manner that the friction force thereof acting on the medium 99 is larger than the friction force of the feed roller 24 acting on the medium 99. This configuration of the separation roller 25 may also suppress the multi-feeding of the media 99. The separation roller 25 may be so configured as to rotate in the forward rotation direction by the drive of the second motor 21B. In this case, the multi-feeding of the media 99 can be suppressed by causing a rotation speed of the separation roller 25 to be lower than a rotation speed of the feed roller 24.

The separation roller 25 of the present embodiment is configured in such a manner that separating power for separating the medium 99 is variable. A pressing mechanism 27 is attached to the separation roller 25. The pressing mechanism 27 is a mechanism configured to press the separation roller 25 against the feed roller 24. In the present embodiment, the separating power of the separation roller 25 is determined by pressing power of the pressing mechanism 27.

The pressing mechanism 27 is constituted of, for example, a spring. The pressing mechanism 27 presses a shaft of the separation roller 25 against the feed roller 24, thereby pressing the separation roller 25 against the feed roller 24. By the pressing mechanism 27 pressing the separation roller 25, power for nipping the medium 99 at the nip point P is secured. The pressing mechanism 27 is configured in such a manner that the pressing power for pressing the separation roller 25 is variable. The pressing power of the pressing mechanism 27 is changed by the control unit 22.

The rotational load applied to the separation roller 25 is varied by the pressing power with which the pressing mechanism 27 presses the separation roller 25 against the feed roller 24. As the pressing power of the pressing mechanism 27 is larger, the separation roller 25 more strongly makes contact with the feed roller 24, and therefore the torque of the feed roller 24 is likely to be transmitted to the separation roller 25. In other words, in this case, the rotational load applied to the separation roller 25 is likely to become large. As the pressing power of the pressing mechanism 27 applied to the separation roller 25 is smaller, the load of the separation roller 25 is unlikely to be applied to the feed roller 24, and therefore the torque of the feed roller 24 is unlikely to be transmitted to the separation roller 25. In other words, in this case, the rotational load applied to the separation roller 25 is likely to become small.

When the torque of the feed roller 24 is likely to be transmitted to the separation roller 25, the connection between the separation roller 25 and the second motor 21B by the torque limiter 26A is likely to be shut off. Because of this, the separating power of the separation roller 25 that causes the medium 99 to be separated becomes small. In contrast, when the torque of the feed roller 24 is unlikely to be transmitted to the separation roller 25, the separating power of the separation roller 25 becomes large. In this manner, in the present embodiment, by the pressing power of the pressing mechanism 27 being changed, the separating power of the separation roller 25 is changed.

The torque limiter 26A may not be provided when the separation roller 25 is provided with the clutch 26B. For example, when the rotational load applied to the separation roller 25 becomes equal to or larger than the predetermined one, the connection between the separation roller 25 and the second motor 21B by the clutch 26B may be shut off by the control unit 22 controlling the clutch 26B. This makes it possible to change the separating power of the separation roller 25 by the control unit 22.

The sensor 16 of the present embodiment is located in a position overlapping with the feeding section 15 in the transport direction Y. In other words, the sensor 16 is located in such a manner as to overlap with the feeding section 15 when viewed from a width direction X. The sensor 16 includes a light-emitting element 28 configured to emit light, and a light-receiving element 29 configured to receive light. The light-emitting element 28 and the light-receiving element 29 are so located as to oppose each other. The light-emitting element 28 and the light-receiving element 29 are so located as to nip the transport path 23 therebetween. The light-emitting element 28 is attached to the housing 12. The light-receiving element 29 is attached to the cover 13.

While the light-receiving element 29 is receiving light emitted by the light-emitting element 28, the sensor 16 is in an OFF state. The OFF state refers to a state in which the medium 99 is not detected. While the light-receiving element 29 is not receiving light emitted by the light-emitting element 28, the sensor 16 is in an ON state. The ON state refers to a state in which the medium 99 is detected. In other words, when the light travelling from the light-emitting element 28 toward the light-receiving element 29 is blocked by the medium 99, the sensor 16 detects the medium 99. As described above, the sensor 16 of the present embodiment is a transmission-type optical sensor.

The sensor 16 may be a reflection-type optical sensor. The sensor 16 may be a contact-type sensor configured to detect the medium 99 by the contact with a lever. The sensor 16 may be a sensor that is so configured as to detect the medium 99 by image capturing.

A plurality of sensors 16 is provided. The sensor 16 of the present embodiment is constituted of a pair of the light-emitting element 28 and the light-receiving element 29. The plurality of sensors 16 is aligned in the feeding direction of the medium 99 to be fed, thereby forming a sensor line 31. In other words, the sensor line 31 of the present embodiment extends in the transport direction Y. When the plurality of sensors 16 is so aligned as to form the sensor line 31, the medium 99 can be detected at a plurality of positions.

The sensor line 31 of the present embodiment is formed of eight of the sensors 16. Because of this, the medium 99 can be detected at eight positions with this sensor line 31. In the present embodiment, the eight light-emitting elements 28 are provided, whereas only one light-receiving element 29 is provided. In other words, the plurality of sensors 16 is so configured as to share a single light-receiving element 29. The plurality of sensors 16 is constituted of each individual light-emitting element 28 and the single light-receiving element 29 being shared. By the light-emitting elements 28 respectively shifting the light emission timings, the medium 99 can be detected at a plurality of positions even by the single light-receiving element 29.

When the plurality of sensors 16 is constituted by sharing the light-receiving element 29, a lens 32 may be disposed between the light-emitting elements 28 and the light-receiving element 29. The lens 32 may be, for example, a convex lens, a Fresnel lens, or a diffraction lens. The lens 32 refracts the light emitted from the light-emitting element 28 toward the light-receiving element 29. This makes it possible to collect the light emitted from the respective light-emitting elements 28 toward the light-receiving element 29, and therefore the medium 99 can be precisely detected at a plurality of positions. The same number of light-receiving elements 29 as the number of light-emitting elements 28 may be provided.

The reader unit 18 is located downstream of the feeding section 15 and the sensors 16 in the transport direction Y. The reader unit 18 reads out an image recorded on one surface of the medium 99 that is transported on the transport path 23. The reader unit 18 is constituted of, for example, an image sensor. The two reader units 18 of the present embodiment are provided. The two reader units 18 are so located as to oppose each other and nip the transport path 23 therebetween. This makes it possible to read out both images recorded on one surface and the other surface of the medium 99 at a time by the respective reader units 18.

The transport rollers 19 are so disposed as to be paired with each other. The transport rollers 19 are so disposed as to nip the transport path 23 therebetween. At least one pair of transport rollers 19 is provided. In the present embodiment, pairs of transport rollers 19 are provided at a total of two positions including a position upstream of the reader units 18 and a position downstream of the reader units 18 in the transport direction Y. The transport rollers 19 transport the medium 99 along the transport path 23 by rotating in a state of nipping the medium 99 therebetween. The transport rollers 19 rotate in the forward rotation direction by the drive of the second motor 21B. The pair of transport rollers 19 may be configured in such a manner that one of them is driven by the other one. In other words, the pair of transport rollers 19 may be configured in such a manner that any one of them rotates by the drive of the second motor 21B.

The control unit 22 is configured to include, for example, a CPU, a memory, and the like. The control unit 22 controls the medium feeding device 11 by the CPU executing a program stored in the memory. The control unit 22 has, as modes in which the medium feeding device 11 operates, a first mode, a second mode, and a third mode. The medium feeding device 11 of the present embodiment normally operates in the first mode. The second mode is a mode in which the separating power of the separation roller 25 is larger than that in the first mode. The third mode is a mode in which the separating power of the separation roller 25 is larger than that in the second mode.

The first mode is a mode in which the separation roller 25 is not driven. In the first mode, the separation roller 25 is driven by the rotation of the feed roller 24 when the medium 99 is fed. In the present embodiment, a state in which the connection between the separation roller 25 and the second motor 21B by the clutch 26B is shut off corresponds to the first mode. When multiple sheets of the media 99 are superposed, the separation roller 25 causes the medium 99 to be separated by using rotational resistance of the separation roller 25 itself and the friction force acting on the medium 99. Accordingly, the separating power of the separation roller 25 is small in the first mode.

The second mode is a mode in which the separation roller 25 is driven by the drive of the second motor 21B. In the second mode, the separation roller 25 rotates in the reverse rotation direction as long as a rotational load equal to or larger than a predetermined value is not applied thereto from the feed roller 24. Thus, the separating power of the separation roller 25 in the second mode is larger than the separating power of the separation roller 25 in the first mode.

The third mode is a mode in which the separation roller 25 is driven by the drive of the second motor 21B and the pressing power of the pressing mechanism 27 is small. The pressing power of the pressing mechanism 27 in the third mode is smaller than the pressing power of the pressing mechanism 27 in the second mode. In the third mode, since the pressing power of the pressing mechanism 27 is small, the rotational load from the feed roller 24 is unlikely to be applied to the separation roller 25. Thus, the separating power of the separation roller 25 in the third mode is larger than the separating power of the separation roller 25 in the second mode.

The separation roller 25 may be driven in the first mode. In this case, the pressing power of the pressing mechanism 27 may differ in the first, second, and third modes in a stepwise manner. In other words, it is sufficient that the pressing power of the pressing mechanism 27 in the second mode is smaller than the pressing power of the pressing mechanism 27 in the first mode. It is sufficient that the pressing power of the pressing mechanism 27 in the third mode is smaller than the pressing power of the pressing mechanism 27 in the second mode. With this, the separating power of the separation roller 25 can be so configured as to be different in the first, second, and third modes.

Figure 2:
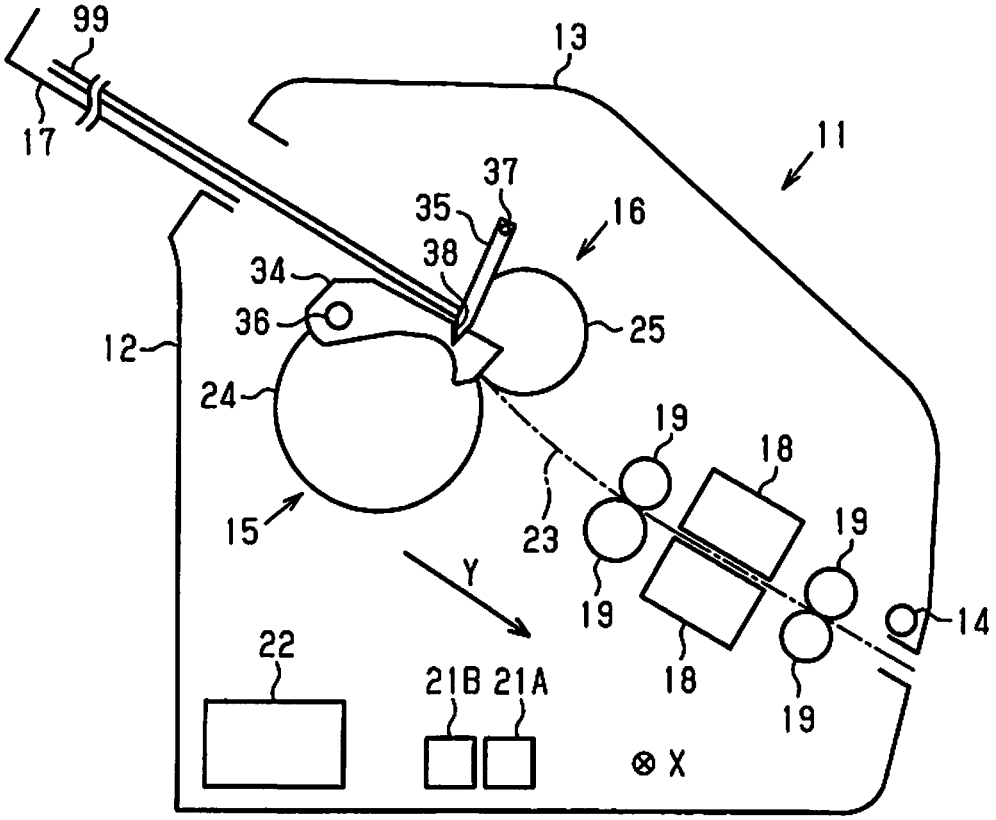
FIG. 2 is a side view when a set guide is located in a first position.

As illustrated in FIG. 2, the medium feeding device 11 may include a set guide 34 for supporting the medium 99 to be set. The set guide 34 supports the medium 99 stacked in the tray 17. The set guide 34 supports a leading end portion of the medium 99 stacked in the tray 17. The set guide 34 supports the medium 99 in such a manner that the leading end portion of the medium 99 stacked in the tray 17 does not make contact with the feed roller 24. The set guide 34 is attached to the housing 12.

The medium feeding device 11 may include a stopper 35 configured to determine a position of the medium 99 to be set. The stopper 35 is located in such a manner that the leading end portion of the medium 99 stacked in the tray 17 is brought into contact with the stopper 35. By making contact with the leading end portion of the medium 99, the stopper 35 determines the position of the medium 99. The stopper 35 supports the medium 99 in such a manner as to prevent the set medium 99 from making contact with the separation roller 25. The stopper 35 is attached to the cover 13.

Figure 3:
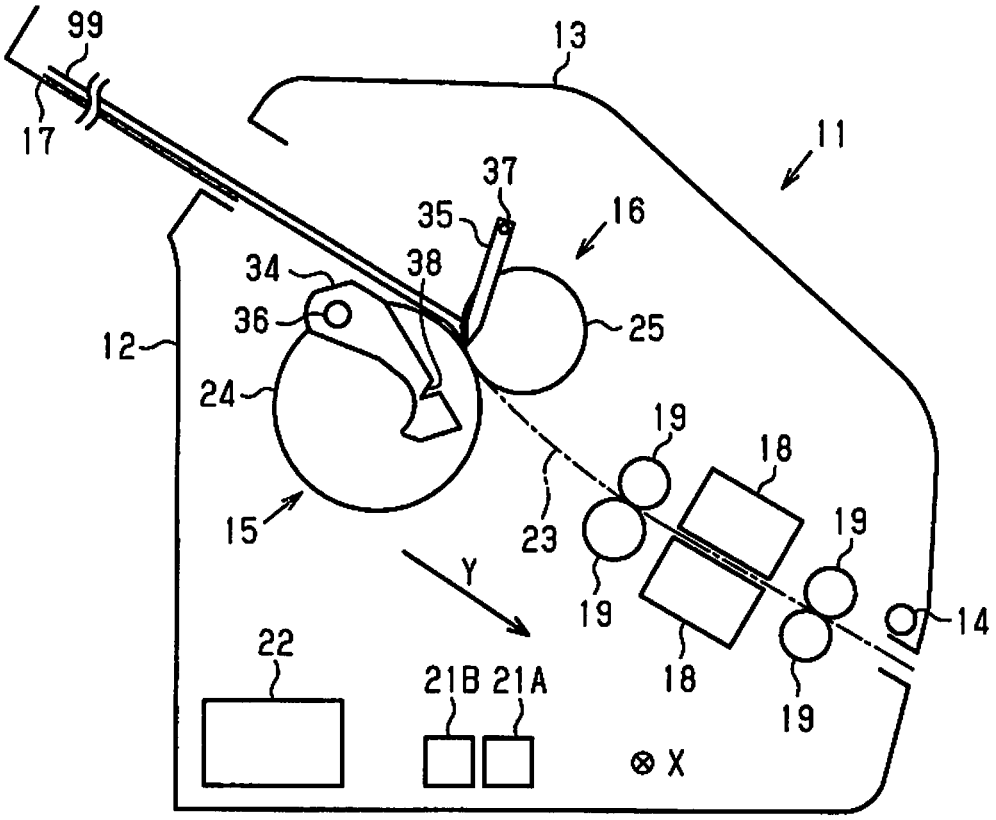
FIG. 3 is a side view when a set guide is located in a second position.

As illustrated in FIG. 2 and FIG. 3, the set guide 34 is so constituted as to rotate about a shaft 36. In the set guide 34, the shaft 36 is located in a base end portion on the opposite side to the leading end portion that makes contact with the medium 99. By rotating about the shaft 36, the set guide 34 is displaced between a first position illustrated in FIG. 2 and a second position illustrated in FIG. 3. The set guide 34 supports, at the first position, the leading end portion of the medium 99 stacked in the tray 17. The set guide 34 does not support, at the second position, the leading end portion of the medium 99 stacked in the tray 17. When the set guide 34 is located in the second position, the leading end portion of the medium 99 stacked in the tray 17 can make contact with the feed roller 24.

The stopper 35 is so constituted as to rotate about a shaft 37. In the stopper 35, the shaft 37 is located in a base end portion on the opposite side to a leading end portion that makes contact with the medium 99. By rotating about the shaft 37, the stopper 35 is displaced between a first position illustrated in FIG. 2 and a second position illustrated in FIG. 3. By making contact, at the first position, with the leading end portion of the medium 99 stacked in the tray 17, the stopper 35 determines the position of the medium 99. When the stopper 35 is located in the second position, the leading end portion of the medium 99 stacked in the tray 17 can make contact with the separation roller 25.

In the present embodiment, when the set guide 34 and the stopper 35 are both located in the second position, the medium 99 stacked in the tray 17 can be fed. When the medium feeding device 11 does not feed the medium 99, the set guide 34 and the stopper 35 are both located in the first position.

The set guide 34 may include a groove 38 that is so constituted as to catch the leading end portion of the stopper 35 located in the first position. By the leading end portion of the stopper 35 being caught in the groove 38 of the set guide 34 located in the first position, a risk that the stopper 35 is displaced due to the load of the medium 99 is reduced.

When the medium 99 is fed, the set guide 34 is displaced from the first position to the second position by the control unit 22. At this time, the state in which the stopper 35 is caught in the set guide 34 by the groove 38 is removed. The stopper 35 is displaced from the first position to the second position due to the load of the medium 99 stacked in the tray 17.

The shaft 37 of the stopper 35 may be provided with a spring. With this, when the medium 99 stacked in the tray 17 is no longer present, the stopper 35 is displaced from the second position to the first position due to the elastic force of the spring. The stopper 35, like the set guide 34, may be so configured as to be controlled by the control unit 22.

Figure 4:
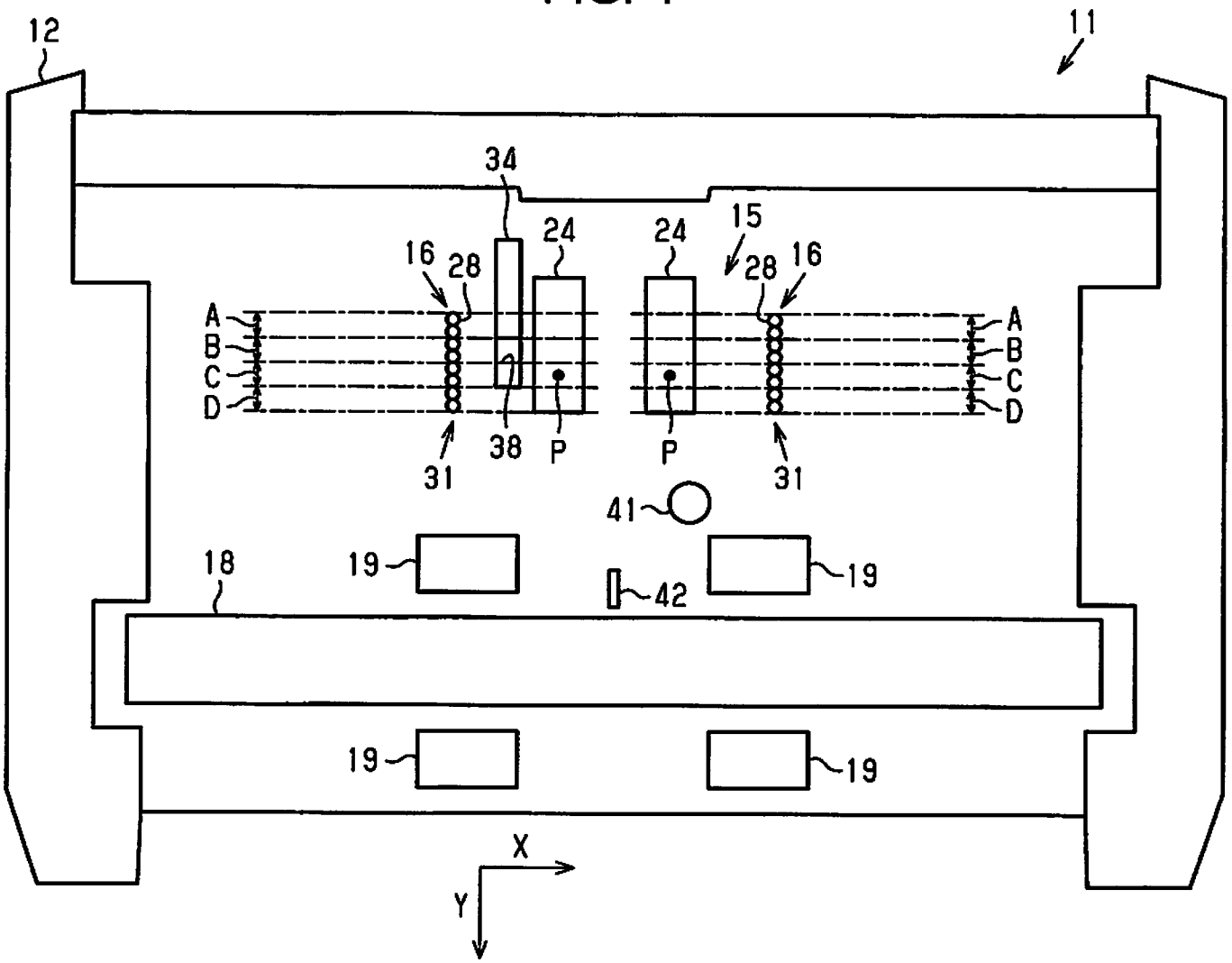
FIG. 4 is a plan view of a housing.

As illustrated in FIG. 4, a plurality of sensor lines 31 is arranged in such a manner that the sensors 16 overlap with each other in the width direction X. The two sensor lines 31 of the present embodiment are arranged in the width direction X. The sensor line 31 is so configured as to extend, in the transport direction Y as a feeding direction, from an upstream region B upstream of the nip point P, a nip region C including the nip point P, and to a downstream region D downstream of the nip point P. Thus, the sensors 16 are configured to detect the medium 99 in the upstream region B, the nip region C, and the downstream region D. In the present embodiment, the light-emitting element 28 constituting the sensor 16 is located in each of the upstream region B, the nip region C, and the downstream region D, so as to detect the medium 99 in each region.

In the two sensor lines 31, the sensors 16 located in the upstream region B overlap with each other in the width direction X. In the two sensor lines 31, the sensors 16 located in the nip region C overlap with each other in the width direction X. In the two sensor lines 31, the sensors 16 located in the downstream region D overlap with each other in the width direction X. The two sensor lines 31 are so located as to overlap with each other when viewed from the width direction X. In the present embodiment, the two sensor lines 31 are located in such a manner that the light-emitting elements 28 overlap with each other when viewed from the width direction X.

When the leading end of the medium 99 is detected in the upstream region B by one of the sensor lines 31 among the two sensor lines 31 and the leading end of the medium 99 is also detected in the nip region C by the other one of the sensor lines 31, it is understood that the medium 99 is slanted. In this manner, the control unit 22 detects a skew, which is a slant of the medium 99, based on detection results of the sensors 16. In other words, the slant of the leading end of the medium 99 is detected by two sensors 16 overlapping in the width direction X. Thus, the skew of the medium 99 is detected. Three or more of the sensor lines 31 may be disposed in the width direction X. As the number of sensor lines 31 is larger, precision in detection of the skew is enhanced. The two sensor lines 31 may be located being spaced from each other in the width direction X. With this, the precision in detection of the skew is enhanced.

Two or more of the sensors 16 may be provided in each region. In other words, the plurality of sensors 16 may be disposed in each of the upstream region B, the nip region C, and the downstream region D. The two sensors 16 of the present embodiment are provided in each of the upstream region B, the nip region C, and the downstream region D. By disposing the plurality of sensors 16 in each of the regions, the precision in detection of the skew is enhanced.

The sensor line 31 may be so constituted as to extend from a set region A located upstream of the upstream region B through the downstream region D in the transport direction Y, which is identical with the feeding direction. The sensor 16 detects, in the set region A, the medium 99 supported by the set guide 34. Thus, the medium 99 stacked in the tray 17 is detected by the sensor 16. In the two sensor lines 31, the sensors 16 located in the set region A overlap with each other in the width direction X. In other words, presence or absence of the medium 99 in the tray 17 can be detected by the sensors 16 in the set region A. The skew of the medium 99 supported by the set guide 34 can also be detected by the two sensors 16 overlapping with each other in the set region A in the width direction X. Two or more of the sensors 16 may be disposed in the set region A.

The sensor lines 31 may be so located as to nip the feeding section 15 therebetween in the width direction X. This widens an interval between the sensor lines 31 in the width direction X. With this, the precision in detection of the skew is enhanced. In the present embodiment, two feed rollers 24 are disposed being spaced from each other in the width direction X. The sensor lines 31 are located in such a manner as to nip the two feed rollers 24 therebetween in the width direction X. The separation rollers 25 in the same number as the feed rollers 24 are provided in such a manner as to oppose the feed rollers 24. The set guide 34 is located between the feed roller 24 and the sensor line 31 in the width direction X. A plurality of set guides 34 may be provided.

The medium feeding device 11 may include a multi-feed sensor 41 configured to detect multi-feeding of the media 99 fed by the feeding section 15. The multi-feed sensor 41 is so constituted as to detect a state where two or more of the media 99 are superimposed. The multi-feed sensor 41 detects multi-feeding of the media 99 by using ultrasonic waves, for example. The sensor line 31 is located upstream of the multi-feed sensor 41 in the transport direction Y identical with the feeding direction. This makes it possible to detect a skew of the medium 99 before the multi-feed sensor 41 detects the multi-feeding of the media 99. The multi-feed sensor 41 of the present embodiment is located downstream of the feed roller 24 and upstream of the transport roller 19 in the transport direction Y.

The medium feeding device 11 may include an end sensor 42 configured to detect the medium 99 at a position downstream of the downstream region D in the transport direction Y identical with the feeding direction. The end sensor 42 is a contact-type sensor configured to detect the medium 99 by the medium 99 making contact with a lever, for example. The end sensor 42 comes to be in an ON state when the medium 99 is detected, and comes to be in an OFF state when the medium 99 is not detected.

The end sensor 42 is located between the reader unit 18 and the transport roller 19 in the transport direction Y. When the end sensor 42 is switched from the OFF state to the ON state, it is understood that a leading end of the medium 99 has reached the end sensor 42. When the end sensor 42 is switched from the ON state to the OFF state, it is understood that a rear end of the medium 99 has passed through the end sensor 42. The medium feeding device 11 of the present embodiment starts to read with the reader unit 18 when the end sensor 42 is switched from the OFF state to the ON state.

Next, feeding operation carried out by the medium feeding device 11 will be described below. The medium feeding device 11 carries out feeding operation when the feeding section 15 feeds the medium 99.

Figure 5A:
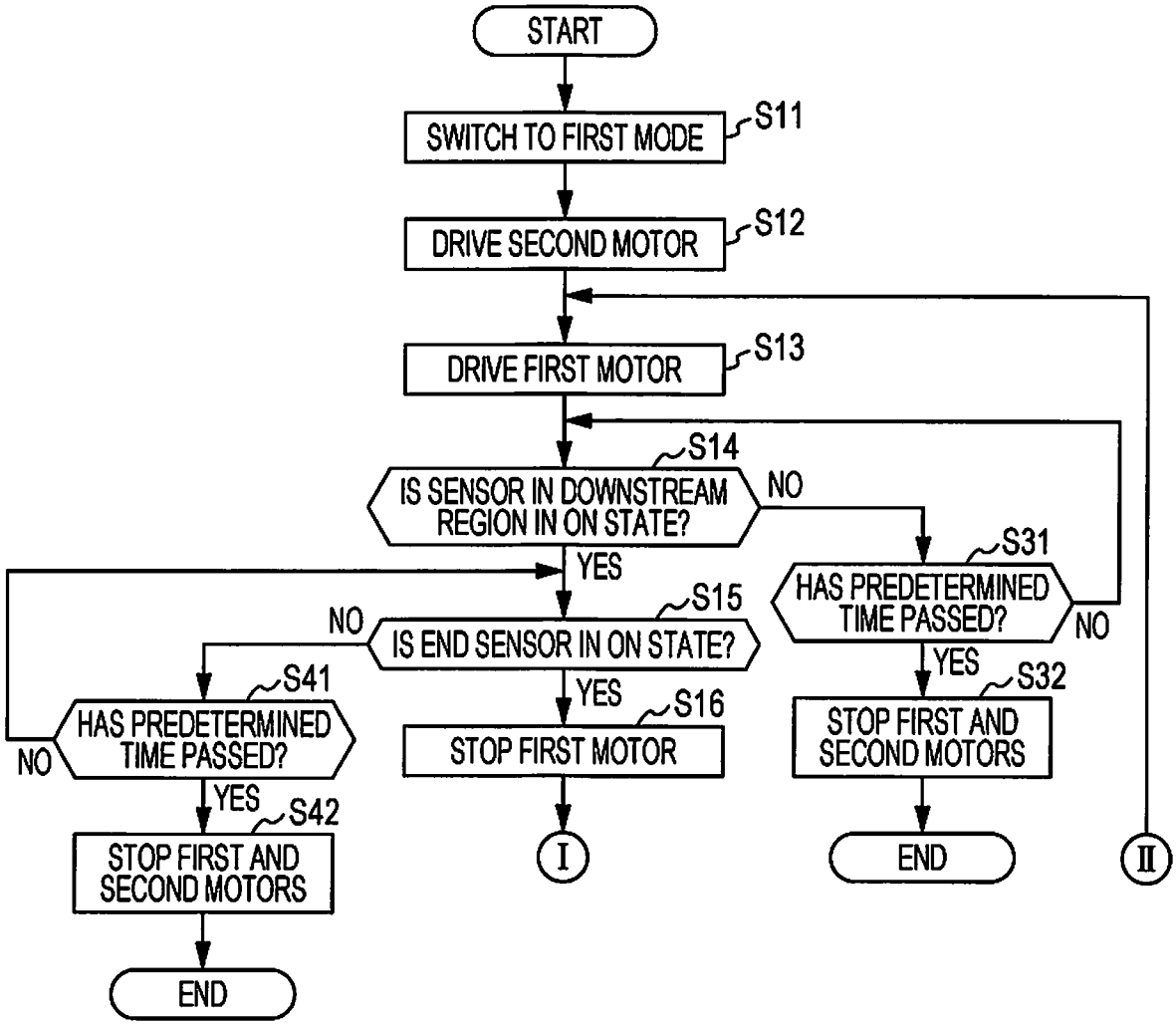
FIG. 5A is a flowchart illustrating a process routine of a feeding operation.
Figure 5B:
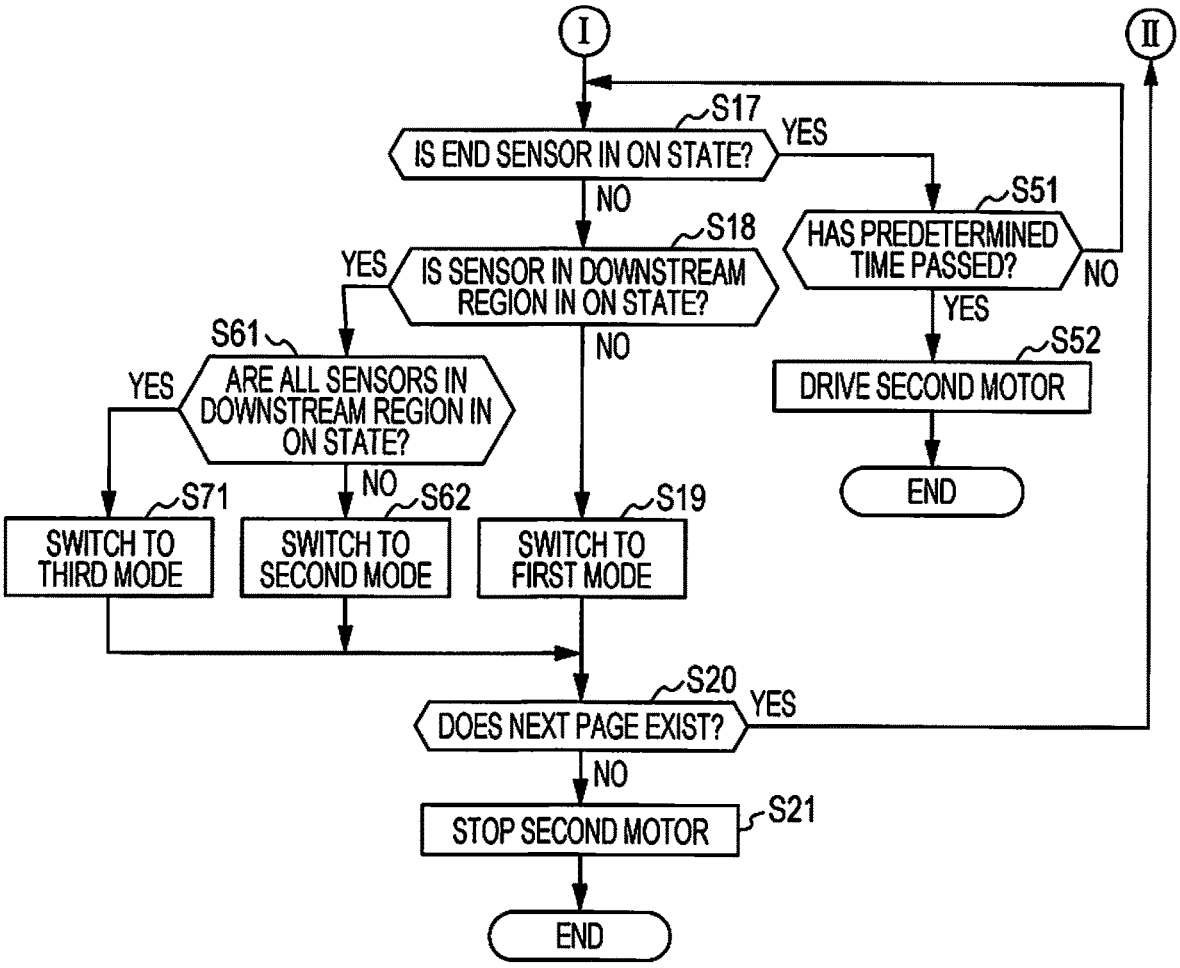
FIG. 5B is a flowchart illustrating a process routine of a feeding operation.

As illustrated in FIGS. 5A and 5B, the control unit 22 configured to carry out the feeding operation switches the mode of the medium feeding device 11 to the first mode in Step S11 first. At this time, the control unit 22 shuts off, by controlling the clutch 26B, the connection between the separation roller 25 and the second motor 21B by the clutch 26B.

The control unit 22 drives the second motor 21B in Step S12. By the second motor 21B being driven, the transport roller 19 rotates. When the mode of the medium feeding device 11 is the first mode, the connection between the separation roller 25 and the second motor 21B is shut off. Due to this, in this case, even when the second motor 21B is driven, the separation roller 25 does not rotate. Accordingly, in Step S12, when the medium feeding device 11 is in the first mode, the transport roller 19 rotates by the drive of the second motor 21B, but the separation roller 25 does not rotate. In Step S12, when the medium feeding device 11 is in the second mode or the third mode, both the separation roller 25 and transport roller 19 rotate by the drive of the second motor 21B.

The control unit 22 drives the first motor 21A in Step S13. By the first motor 21A being driven, the feed roller 24 rotates. By the rotation of the feed roller 24, the medium 99 stacked in the tray 17 is fed.

The control unit 22 determines, in Step S14, whether or not the sensor 16 in the downstream region D is in the ON state. In other words, the control unit 22 determines, in Step S14, whether or not the medium 99 is located in the downstream region D. When the sensor 16 in the downstream region D is in the ON state, the control unit 22 shifts the process to Step S15. When the sensor 16 in the downstream region D is in the OFF state, the control unit 22 shifts the process to Step S31.

In Step S31, the control unit 22 determines whether or not a predetermined time has passed. In step S31, the control unit 22 refers to the time having passed since the first motor 21A was made to drive in Step S13. In other words, in Step S31, the control unit 22 determines whether or not the time having passed since the first motor 21A was made to drive exceeds the predetermined time. When the predetermined time has passed, the control unit 22 shifts the process to Step S32. When the predetermined time has not passed yet, the control unit 22 returns the process to Step S14.

In Step S14 and Step S31, the control unit 22 determines whether or not the medium 99 stacked in the tray 17 reaches the downstream region D before the predetermined time has passed since the first motor 21A was made to drive. In other words, the control unit 22 determines, in Step S14 and Step S31, whether or not the medium 99 is normally fed. When the medium 99 is normally fed, the control unit 22 shifts the process to Step S15. When the medium 99 is not normally fed, the control unit 22 shifts the process to Step S32.

The control unit 22 stops the first motor 21A and the second motor 21B in Step S32. With this, the feed roller 24, the separation roller 25, and the transport roller 19 are stopped. After the first motor 21A and the second motor 21B having been stopped, the control unit 22 ends the feeding process because the medium 99 is not normally fed. At this time, as a reason why the medium 99 is not normally fed, it can be thought of that the medium 99 is possibly not set in the tray 17. Therefore, when the feeding process is carried out, it may be determined whether or not the medium 99 is set in the tray 17 by using the sensor 16 located in the set region A.

When the sensor 16 in the downstream region D is in the ON state in Step S14, the control unit 22 determines, in Step S15, whether or not the end sensor 42 is in the ON state. When the end sensor 42 is in the ON state, the control unit 22 shifts the process to Step S16. When the end sensor 42 is in the OFF state, the control unit 22 shifts the process to Step S41.

In Step S41, the control unit 22 determines whether or not a predetermined time has passed. In step S41, the control unit 22 refers to the time having passed since the sensor 16 in the downstream region D came to be in the ON state in Step S14. In other words, in Step S41, the control unit 22 determines whether or not the time having passed since the sensor 16 in the downstream region D detected the medium 99 exceeds the predetermined time. When the predetermined time has passed, the control unit 22 shifts the process to Step S42. When the predetermined time has not passed yet, the control unit 22 returns the process to Step S15.

In Step S15 and Step S41, the control unit 22 determines whether or not the medium 99 reaches the end sensor 42 before the predetermined time has passed since the sensor 16 in the downstream region D detected the above medium 99. In other words, the control unit 22 determines, in Step S15 and Step S41, whether or not the medium 99 is normally fed on the transport path 23 from the downstream region D to the end sensor 42. When the medium 99 is normally fed, the control unit 22 shifts the process to Step S16. When the medium 99 is not normally fed, the control unit 22 shifts the process to Step S42.

The control unit 22 stops the first motor 21A and the second motor 21B in Step S42. With this, the feed roller 24, the separation roller 25, and the transport roller 19 are stopped. After the first motor 21A and the second motor 21B having been stopped, the control unit 22 ends the feeding process because the medium 99 is not normally fed.

When the end sensor 42 is in the ON state in Step S15, the control unit 22 stops the first motor 21A in step S16. With this, the feed roller 24 is stopped. When the end sensor 42 detects the medium 99, the stated medium 99 is being nipped between the transport rollers 19. Therefore, when the end sensor 42 detects the medium 99, the first motor 21A is stopped because the medium 99 has been normally fed.

The control unit 22 determines, in Step S17, whether or not the end sensor 42 is in the ON state. When the end sensor 42 is in the ON state, the control unit 22 shifts the process to Step S51. When the end sensor 42 is in the OFF state, the control unit 22 shifts the process to Step S18.

In Step S51, the control unit 22 determines whether or not a predetermined time has passed. In step S51, the control unit 22 refers to the time having passed since the first motor 21A was stopped in Step S16. In other words, in Step S51, the control unit 22 determines whether or not the time having passed since the first motor 21A was stopped exceeds the predetermined time. When the predetermined time has passed, the control unit 22 shifts the process to Step S52. When the predetermined time has not passed yet, the control unit 22 returns the process to Step S17.

In Step S17 and Step S51, the control unit 22 determines whether or not the medium 99 has passed through the end sensor 42 before the predetermined time has passed since the first motor 21A was stopped. In other words, the control unit 22 determines, in Step S17 and Step S51, whether or not the medium 99 is normally transported on the transport path 23. When the medium 99 is normally transported, the rear end of the medium 99 passes through the end sensor 42 before the predetermined time has passed. Therefore, when the medium 99 is normally transported, the end sensor 42 is switched from the ON state to the OFF state before the predetermined time has passed. When the medium 99 is normally transported, the control unit 22 shifts the process to Step S18. When the medium 99 is not normally transported, the control unit 22 shifts the process to Step S52.

The control unit 22 stops the second motor 21B in Step S52. With this, the transport roller 19 is stopped. In Step S52, when the medium feeding device 11 is in the second mode or the third mode, both the separation roller 25 and the transport roller 19 are stopped by the second motor 21B being stopped. After the second motor 21B having been stopped, the control unit 22 ends the feeding process because the medium 99 is not normally transported.

When the end sensor 42 is in the OFF state in Step S17, the control unit 22 determines, in Step S18, whether or not the sensor 16 in the downstream region D is in the ON state. When the sensor 16 in the downstream region D is in the ON state, the control unit 22 shifts the process to Step S61. When the sensor 16 in the downstream region D is in the OFF state, the control unit 22 shifts the process to Step S19.

When the medium 99 is fed in the process from Step S11 to Step S17, a medium 99 next to the above medium 99 is also fed along with the stated medium 99 in some cases. Due to this, when a rear end of the preceding medium 99 passes through the end sensor 42, a leading end of the following medium 99 is located downstream of the nip point P in some cases. When the feeding of the media 99 is continuously carried out in the above state, there arises a risk of occurrence of multi-feeding of the media 99. Accordingly, when the end sensor 42 is switched from a state where it detects the medium 99 to a state where it does not detect the medium 99, it is preferable that the medium feeding device 11 be in the first mode in a case in which the sensor 16 in the downstream region D does not detect the medium 99, and be in the second mode in a case in which the sensor 16 in the downstream region D detects the medium 99. When the end sensor 42 is switched from a state where it detects the medium 99 to a state where it does not detect the medium 99, it is more preferable that the medium feeding device 11 be in the first mode in a case in which the sensors 16 in the downstream region D do not detect the medium 99, be in the second mode in a case in which part of the sensors 16 in the downstream region D detects the medium 99, and be in the third mode in a case in which all the sensors 16 in the downstream region D detect the medium 99.

When the sensor 16 in the downstream region D is in the OFF state in Step S18, it is understood that the following medium 99 is not located in the downstream region D. In this case, the risk of multi-feeding the media 99 is low. When the sensor 16 in the downstream region D is in the ON state in Step S18, it is understood that the following medium 99 is located in the downstream region D. When the feeding is continuously carried out in the above state, there arises a high risk of occurrence of the multi-feeding of the media 99. Therefore, in Step S18, the control unit 22 increases the separating power of the separation roller 25 when the sensor 16 in the downstream region D is in the ON state.

The control unit 22 determines, in Step S61, whether or not all of the sensors 16 in the downstream region D are in the ON state. In the present embodiment, the four sensors 16 are located in the downstream region D. When all the sensors 16 in the downstream region D are in the ON state, the control unit 22 shifts the process to Step S71. When not all of the sensors 16 in the downstream region D are in the ON state, that is, when part of the sensors 16 in the downstream region D is in the ON state, the control unit 22 shifts the process to Step S62.

The control unit 22 switches the current mode to the second mode in Step S62. At this time, the control unit 22 connects, by controlling the clutch 26B, the separation roller 25 and the second motor 21B by the clutch 26B. When the switching to the second mode is completed, the control unit 22 shifts the process to Step S20.

When all the sensors 16 in the downstream region D are in the ON state in Step S61, the control unit 22 switches the current mode to the third mode in step S71. At this time, the control unit 22 connects, by controlling the clutch 26B, the separation roller 25 and the second motor 21B by the clutch 26B. The control unit 22 weakens the pressing power applied by the pressing mechanism 27. When the switching to the third mode is completed, the control unit 22 shifts the process to Step S20.

When all the sensors 16 in the downstream region D are in the ON state, the leading end of the following medium 99 is located downstream more than that in a case where part of the sensors 16 in the downstream region D is in the ON state. This raises a high risk of occurrence of the multi-feeding of the media 99. As such, when all the sensors 16 in the downstream region D are in the ON state, the third mode in which the separating power is largest is selected.

When the sensors 16 in the downstream region D are in the OFF state in Step S18, the control unit 22 switches the current mode to the first mode in step S19. At this time, the control unit 22 shuts off, by controlling the clutch 26B, the connection between the separation roller 25 and the first motor 21A by the clutch 26B. When the switching to the first mode is completed, the control unit 22 shifts the process to Step S20.

In Step S20, the control unit 22 determines whether or not the next page exists. In other words, the control unit 22 determines whether or not the medium 99 still remains in the tray 17. When the next page exists, the control unit 22 returns the process to Step S13. When the next page does not exist, the control unit 22 shifts the process to Step S21.

The control unit 22 stops the second motor 21B in Step S21. By the second motor 21B being stopped, the transport roller 19 is stopped. In Step S21, when the medium feeding device 11 is in the second mode or the third mode, both the separation roller 25 and the transport roller 19 are stopped by the second motor 21B being stopped. After the second motor 21B having been stopped, the control unit 22 ends the feeding process.

Next, actions and effects of the above-described embodiment will be described below.

1. The two sensor lines 31 are arranged in such a manner that the sensors 16 overlap with each other in the width direction X of the medium 99 to be fed, and are so configured as to extend, in the feeding direction, from the upstream region B upstream of the nip point P where the feed roller 24 and the separation roller 25 make contact with each other, the nip region C including the nip point P, and to the downstream region D downstream of the nip point P. This makes it possible to detect a skew of the medium 99 in each of the upstream region B, the nip region C, and the downstream region D. Accordingly, the precision in detection of the skew can be enhanced.

2. The sensor 16 detects, in the set region A, the medium 99 supported by the set guide 34. This makes it possible to detect the skew of the medium 99 in the set region A. Accordingly, the skew of the medium 99 can be detected before the medium 99 being fed. Thus, the skew can be canceled with ease.

3. The sensor lines 31 are so located as to nip the feeding section 15 therebetween in the width direction X. This widens an interval between the sensor lines 31 in the width direction X, thereby making it possible to enhance the precision in skew detection.

4. The sensor line 31 is located upstream of the multi-feed sensor 41 in the feeding direction. This makes it possible to detect a skew of the medium 99 by the sensor 16 before the multi-feed sensor 41 detects the multi-feeding of the media 99.

5. Two or more of the sensors 16 are provided in each region. This makes it possible to enhance the precision in skew detection in comparison with a case where only one sensor 16 is provided in each region.

6. When the end sensor 42 is switched from a state where it detects the medium 99 to a state where it does not detect the medium 99, the medium feeding device 11 comes to be in the first mode when the sensor 16 in the downstream region D does not detect the medium 99, and comes to be in the second mode when the sensor 16 in the downstream region D detects the medium 99.

When the end sensor 42 is switched from a state where it detects the medium 99 to a state where it does not detect the medium 99, it is understood that the feeding of the medium 99 has been completed. At this time, when the sensor 16 located in the downstream region D does not detect a medium 99, it is understood that the medium 99 next to the medium 99 having been completely fed has not reached the downstream region D yet. On the other hand, when the sensor 16 located in the downstream region D detects a medium 99, it is understood that the medium 99 next to the medium 99 having been completely fed has been fed down to the downstream region D. In this case, there is a risk of occurrence of the multi-feeding of the media 99. To deal with this, the separating power of the separation roller 25 that causes the medium 99 to be separated is increased, thereby reducing the risk of occurrence of multi-feeding in which multiple sheets of the media 99 are fed. In other words, according to the above-described configuration, when there is a risk of multi-feeding the media 99, the multi-feeding of the media 99 can be suppressed by switching to the second mode.

7. When the end sensor 42 is switched from a state where it detects the medium 99 to a state where it does not detect the medium 99, the medium feeding device 11 comes to be in the first mode in a case in which the sensors 16 in the downstream region D do not detect the medium 99, comes to be in the second mode in a case in which part of the sensors 16 in the downstream region D detects the medium 99, and comes to be in the third mode in a case in which all of the sensors 16 in the downstream region D detect the medium 99.

When the end sensor 42 is switched from a state where it detects the medium 99 to a state where it does not detect the medium 99, it is understood that the feeding of the medium 99 has been completed. At this time, when the sensor 16 located in the downstream region D does not detect a medium 99, it is understood that the medium 99 next to the medium 99 having been completely fed has not reached the downstream region D yet. On the other hand, when part of the sensors 16 located in the downstream region D detects a medium 99, it is understood that the medium 99 next to the medium 99 having been completely fed has been fed down to the downstream region D. In this case, there is a risk of occurrence of the multi-feeding of the media 99. Further, when all of the sensors 16 located in the downstream region D detect a medium 99, there is a risk that the medium 99 next to the medium 99 having been completely fed has been fed to a position downstream of the downstream region D. In this case, there is a high risk of occurrence of multi-feeding. To deal with this, the separating power of the separation roller 25 that causes the medium 99 to be separated is increased, thereby reducing the risk of occurrence of multi-feeding in which multiple sheets of the media 99 are fed. In other words, according to the above-described configuration, when there is a risk of multi-feeding the media 99, the multi-feeding of the media 99 can be suppressed by switching to the second mode. When there is a high risk of multi-feeding the media 99, the multi-feeding of the media 99 can be suppressed by switching to the third mode.

The present embodiment can be implemented by making the following modifications. The present embodiment and the following modifications can be implemented by being combined with each other within a range where no technical inconsistency occurs.

- The feed roller 24, the separation roller 25, and the transport roller 19 may be driven by a single motor.
- A plunger may be employed in place of the clutch 26B. The separating power of the separation roller 25 may be changed by controlling the plunger.
- A planetary gear configured to switch a torque value of the torque limiter 26A may be employed in place of the clutch 26B. For example, a plurality of torque limiters 26A may be provided, and the torque limiter 26A to connect the separation roller 25 and the second motor 21B may be selected by the planetary gear. In this case, by constituting the plurality of torque limiters 26A in such a manner that torque values thereof are different from each other, the separating power of the separation roller 25 can be changed.
- The number of sensors 16 located in each of the set region A, the upstream region B, the nip region C, and the downstream region D may be different from each other.
- The medium feeding device 11 may be constituted in such a manner that, when there is a risk of occurrence of multi-feeding the media 99, the medium 99 is returned to the tray 17 by rotating the separation roller 25 in the reverse rotation direction.
- The sensor line 31 may be formed by the plurality of sensors 16 disposed being spaced from each other in the transport direction Y, which is identical with the feeding direction.

Hereinafter, technical ideas and action effects thereof contrived from the above-described embodiment and the modifications will be described.

Idea 1

Provided is a medium feeding device including a feeding section for feeding a medium and sensors for detecting the medium. The feeding section includes a feed roller and a separation roller, the sensors form a sensor line in which the plurality of sensors is aligned in a feeding direction of the medium to be fed, the two sensor lines are arranged in such a manner that the sensors overlap with each other in a width direction of the medium to be fed, and the sensor lines are so configured as to extend, in the feeding direction, from an upstream region upstream of a nip point where the feed roller and the separation roller make contact with each other, a nip region including the nip point, and to a downstream region downstream of the nip point.

This configuration makes it possible to detect a skew of the medium in each of the upstream region, the nip region, and the downstream region. Accordingly, the precision in detection of the skew can be enhanced.

Idea 2

The medium feeding device described in Idea 1 further includes a set guide for supporting the medium to be set, where the sensor lines are so configured as to extend, in the feeding direction, from a set region upstream of the upstream region through the downstream region, and the sensor is configured to detect, in the set region, the medium supported by the set guide.

This makes it possible to detect a skew of the medium in the set region. Accordingly, since the skew of the medium can be detected before the medium being fed, the skew can be resolved with ease.

Idea 3

In the medium feeding device described in Idea 1 or Idea 2, the sensor lines are so located as to nip the feeding section therebetween in the width direction.

According to this configuration, since an interval between the sensor lines in the width direction is widened, the precision in detection of the skew can be enhanced.

Idea 4

The medium feeding device described in any one of Idea 1 through Idea 3 further includes a multi-feed sensor configured to detect multi-feeding of the media fed by the feeding section, where the sensor lines are located upstream of the multi-feed sensor in the feeding direction.

This configuration makes it possible to detect a skew of the medium by the sensor before the multi-feed sensor detects the multi-feeding of the media.

Idea 5

In the medium feeding device described in any one of Idea 1 through Idea 4, two or more of the above sensors are provided in each region.

This configuration makes it possible to enhance the precision in skew detection in comparison with a case where only one sensor unit is provided in each region.

Idea 6

The medium feeding device described in any one of Idea 1 through Idea 5 further includes an end sensor configured to detect the medium at a position downstream of the downstream region in the feeding direction. When the end sensor is switched from a state where it detects the medium to a state where it does not detect the medium, the medium feeding device comes to be in a first mode in a case in which the sensor in the downstream region does not detect the medium, and comes to be in a second mode in a case in which the sensor in the downstream region detects the medium. The second mode is a mode in which separating power of the separation roller that causes the medium to be separated is larger than the first mode.

When the end sensor is switched from a state where it detects the medium to a state where it does not detect the medium, it is understood that the feeding of the medium has been completed. At this time, when the sensor located in the downstream region does not detect a medium, it is understood that the medium next to the medium having been completely fed has not reached the downstream region yet. On the other hand, when the sensor located in the downstream region detects a medium, it is understood that the medium next to the medium having been completely fed has been fed down to the downstream region. In this case, there is a risk of occurrence of the multi-feeding of the media. To deal with this, the separating power of the separation roller that causes the medium to be separated is increased, thereby reducing the risk of occurrence of multi-feeding in which multiple sheets of media are fed. In other words, according to the above-described configuration, when there is a risk of multi-feeding the media, the multi-feeding of the media can be suppressed by switching to the second mode.

Idea 7

The medium feeding device described in any one of Idea 1 through Idea 5 further includes an end sensor configured to detect the medium at a position downstream of the downstream region in the feeding direction. When the end sensor is switched from a state where it detects the medium to a state where it does not detect the medium, the medium feeding device comes to be in a first mode in a case in which the sensors in the downstream region do not detect the medium, comes to be in a second mode in a case in which part of the sensors in the downstream region detects the medium, and comes to be in a third mode in a case in which all of the sensors in the downstream region detect the medium. The second mode is a mode in which separating power of the separation roller that causes the medium to be separated is larger than the first mode, and the third mode is a mode in which the separating power of the separation roller that causes the medium to be separated is larger than the second mode.

When the end sensor is switched from a state where it detects the medium to a state where it does not detect the medium, it is understood that the feeding of the medium has been completed. At this time, when the sensor located in the downstream region does not detect a medium, it is understood that the medium next to the medium having been completely fed has not reached the downstream region yet. On the other hand, when part of the sensors located in the downstream region detects a medium, it is understood that the medium next to the medium having been completely fed has been fed down to the downstream region. In this case, there is a risk of occurrence of the multi-feeding of the media. Further, when all of the sensors located in the downstream region detect a medium, there is a risk that the medium next to the medium having been completely fed has been fed to a position downstream of the downstream region. In this case, there is a high risk of occurrence of the multi-feeding of the media. To deal with this, the separating power of the separation roller that causes the medium to be separated is increased, thereby reducing the risk of occurrence of multi-feeding in which multiple sheets of media are fed. In other words, according to the above-described configuration, when there is a risk of multi-feeding the media, the multi-feeding of the media can be suppressed by switching to the second mode. When there is a high risk of multi-feeding the media, the multi-feeding of the media can be suppressed by switching to the third mode.

What is claimed is:

1. A medium feeding device comprising:

a feeding section that feeds a medium, the feeding section including a feed roller and a separation roller;

a set guide that supports a bottom surface of the medium to be set, the set guide being configured to move between a first position at which the set guide supports the medium and a second position at which the set guide does not support the medium, and a sensor that detects the medium, the sensor including a plurality of sensor elements that form at least two sensor lines in which the sensor elements are aligned in a feeding direction of the medium to be fed, the two sensor lines being arranged such that the sensor elements overlap with each other in a width direction of the medium to be fed, the width direction being along both of a rotation axis of the feeding roller and a rotation axis of the separation roller, and each of the sensor lines extending, in the feeding direction, from an upstream region upstream of a nip point where the feed roller and the separation roller make contact with each other, through a nip region including the nip point, and to a downstream region downstream of the nip point, wherein a part of the sensor elements overlaps the set guide as viewed in the width direction, the set guide is disposed between the feeding section and one of the two sensor lines in the width direction, and in the feeding direction, a most downstream sensor element among the sensor elements in each of the two sensor lines is disposed at or upstream of a downstream end of one of the feed roller and the separation roller.

2. The medium feeding device according to claim 1, wherein each of the sensor lines extends, in the feeding direction, from a set region upstream of the upstream region to the downstream region, and the sensor is configured to detect, in the set region, the medium supported by the set guide.

3. The medium feeding device according to claim 1, wherein the sensor lines are located such that the feeding section is located between the sensor lines in the width direction.

4. The medium feeding device according to claim 1, further comprising:

a multi-feed sensor configured to detect multi-feeding of the media fed by the feeding section, wherein the sensor lines are located upstream of the multi-feed sensor in the feeding direction.

5. The medium feeding device according to claim 1, wherein two or more of the sensor elements are provided in each region.

6. The medium feeding device according to claim 1, further comprising:

an end sensor configured to detect the medium at a position downstream of the downstream region in the feeding direction, wherein the sensor elements include downstream region sensor elements located in the downstream region, when the end sensor is switched from a state where the end sensor detects the medium to a state where the end sensor does not detect the medium, the medium feeding device comes to be in a first mode in a case in which the downstream region sensor elements do not detect the medium, and comes to be in a second mode in a case in which the downstream region sensor elements detect the medium, and the second mode is a mode in which separating power of the separation roller that causes the medium to be separated is larger than the first mode.

7. The medium feeding device according to claim 1, further comprising:

an end sensor configured to detect the medium at a position downstream of the downstream region in the feeding direction, wherein the sensor elements include downstream region sensor elements located in the downstream region, when the end sensor is switched from a state where the end sensor detects the medium to a state where the end sensor does not detect the medium, the medium feeding device comes to be in a first mode in a case in which part of the downstream region sensor elements do not detect the medium, comes to be in a second mode in a case in which part of the downstream region sensor elements detect the medium, and comes to be in a third mode in a case in which all of the downstream region sensor elements detect the medium, the second mode is a mode in which separating power of the separation roller that causes the medium to be separated is larger than the first mode, and the third mode is a mode in which the separating power of the separation roller that causes the medium to be separated is larger than the second mode.

8. The medium feeding device according to claim 1, further comprising:

a stopper configured to determine a position of the medium to be set, the stopper being configured to move between a first position at which the stopper contacts a leading edge of the medium and the set guide and a second portion position at which the stopper does not contact the set guide.

9. A medium feeding device comprising:

a feeding section that feeds a medium, the feeding section including a pair of a feed roller and a separation roller; and a sensor that detects the medium, the sensor including a plurality of sensor elements that form at least two sensor lines in which the sensor elements are aligned in a feeding direction of the medium to be fed, the two sensor lines being arranged such that the sensor elements overlap with each other in a width direction of the medium to be fed, the width direction being along both of a rotation axis of the feeding roller and a rotation axis of the separation roller, each of the sensor lines extending, in the feeding direction, from an upstream region upstream of a nip point where the feed roller and the separation roller make contact with each other, through a nip region including the nip point, and to a downstream region downstream of the nip point, and all of the sensor elements being located so as to overlap the feed roller as viewed in the width direction.

10. The medium feeding device according to claim 9, further comprising:

a set guide that supports a bottom surface of the medium to be set, the set guide being configured to move between a first position at which the set guide supports the medium and a second position at which the set guide does not support the medium, wherein each of the sensor lines extends, in the feeding direction, from a set region upstream of the upstream region to the downstream region, and the sensor is configured to detect, in the set region, the medium supported by the set guide.

11. The medium feeding device according to claim 10, further comprising:

a stopper configured to determine a position of the medium to be set, the stopper being configured to move between a first position at which the stopper contacts a leading edge of the medium and the set guide and a second position at which the stopper does not contact the set guide.

12. The medium feeding device according to claim 9, further comprising:

an end sensor configured to detect the medium at a position downstream of the downstream region in the feeding direction, wherein the sensor elements include downstream region sensor elements located in the downstream region, when the end sensor is switched from a state where the end sensor detects the medium to a state where the end sensor does not detect the medium, the medium feeding device comes to be in a first mode in a case in which the downstream region sensor elements do not detect the medium, and comes to be in a second mode in a case in which the downstream region sensor elements detect the medium, and the second mode is a mode in which separating power of the separation roller that causes the medium to be separated is larger than the first mode.

13. The medium feeding device according to claim 9, further comprising:

an end sensor configured to detect the medium at a position downstream of the downstream region in the feeding direction, wherein the sensor elements include downstream region sensor elements located in the downstream region, when the end sensor is switched from a state where the end sensor detects the medium to a state where the end sensor does not detect the medium, the medium feeding device comes to be in a first mode in a case in which part of the downstream region sensor elements do not detect the medium, comes to be in a second mode in a case in which part of the downstream region sensor elements detect the medium, and comes to be in a third mode in a case in which all of the downstream region sensor elements detect the medium, the second mode is a mode in which separating power of the separation roller that causes the medium to be separated is larger than the first mode, and the third mode is a mode in which the separating power of the separation roller that causes the medium to be separated is larger than the second mode.

* * * * *